US009894974B2

(12) United States Patent
Bernard et al.

(10) Patent No.: US 9,894,974 B2
(45) Date of Patent: Feb. 20, 2018

(54) HAIR ACCESSORY

(71) Applicants: Julie Bernard, Palm Beach Gardens, FL (US); Helene Bernard, Palm Beach Gardens, FL (US)

(72) Inventors: Julie Bernard, Palm Beach Gardens, FL (US); Helene Bernard, Palm Beach Gardens, FL (US)

(73) Assignee: HJLB, LLC, Palm Beach Gardens, FL (US)

( * ) Notice: Subject to any disclaimer, the term of this patent is extended or adjusted under 35 U.S.C. 154(b) by 296 days.

(21) Appl. No.: 14/665,837

(22) Filed: Mar. 23, 2015

(65) Prior Publication Data

US 2016/0278498 A1 Sep. 29, 2016

(51) Int. Cl.
*A45D 8/00* (2006.01)
*A45D 8/38* (2006.01)
*A45D 8/34* (2006.01)

(52) U.S. Cl.
CPC ..... *A45D 8/38* (2013.01); *A45D 8/34* (2013.01)

(58) Field of Classification Search
CPC ..... A45D 8/38; A45D 2008/004
See application file for complete search history.

(56) References Cited

U.S. PATENT DOCUMENTS 6,116,251 A * 9/2000 Stachowski ..... A45D 8/34 132/273
6,182,921 B1 2/2001 Muylle et al.
7,017,589 B1 3/2006 Minnelli
8,505,555 B1 * 8/2013 Lightfoot-Martin . A45C 11/008 132/274
2009/0071497 A1 * 3/2009 Szlanfucht ..... A41G 5/00 132/210
2012/0138077 A1 * 6/2012 Stuhler ..... A45D 8/34 132/200
2014/0283869 A1 * 9/2014 Sonstegard ..... A45D 8/34 132/275

(Continued)

FOREIGN PATENT DOCUMENTS

GB 1170389 * 11/1969
KR 10-1356661 B1 2/2014

(Continued)

OTHER PUBLICATIONS

International Search Report issued in connection with PCT/US16/22458.

(Continued)

*Primary Examiner* — Todd E Manahan
*Assistant Examiner* — Brianne Kalach
(74) *Attorney, Agent, or Firm* — Akerman LLP

(57) ABSTRACT

According to one embodiment, a hair accessory includes a base and a curved hollow tube coupled to the base. The base is configured to be positioned against a head of a person. The curved hollow tube is configured to provide structural support to a portion of hair of the person gathered around the curved hollow tube. The curved hollow tube has a first end that is coupled directly to the base and a second end distally located from the base. The curved hollow tube includes a plurality of ridges positioned along a length of the curved hollow tube. Each of the plurality of ridges extends along a perimeter of the curved hollow tube.

17 Claims, 5 Drawing Sheets

(56) References Cited

U.S. PATENT DOCUMENTS

2016/0270502 A1* 9/2016 Keenan ..... A45D 8/00

FOREIGN PATENT DOCUMENTS

WO 2006/101492 A1 9/2006
WO WO2006101492 * 9/2006

OTHER PUBLICATIONS

Written Opinion of the International Searching Authority issued in connection with PCT/US16/22458.
Perfect Pony, found at http://www.conair.com/perfect-pony-sup-sup—p-1598-1_141_162.html.
Volume Styler, found at http://www.pretty-pieces.co.uk/Volume-Styler-p/s09Ihanc01.htm.
Barbie Ponytail, found at http://hairdohow2.blogspot.in/2012/04/barbie-ponytail.html.
Create the Perfect Pony, found at http://www.amazon.com/Scunci-Create-the-Perfect-Pony/dp/B0050DFW4G.

* cited by examiner

HAIR ACCESSORY

TECHNICAL FIELD

This disclosure relates generally to the field of cosmetology and more specifically to a hair accessory.

BACKGROUND

Traditionally, a person (such as a woman, or any other person) may have created a pony tail with her hair by gathering the hair at a location near the scalp, and securing the gathered hair with a hair band. Furthermore, the person may also (or alternatively) have used various traditional devices to help create a different style of a pony tail (or to create a more secure pony tail). Such traditional methods (and/or devices) for creating a pony tail, however, may be deficient.

SUMMARY

According to one embodiment, a hair accessory includes a base and a curved hollow tube coupled to the base. The base is configured to be positioned against a head of a person. The curved hollow tube is configured to provide structural support to a portion of hair of the person gathered around the curved hollow tube. The curved hollow tube has a first end that is coupled directly to the base and a second end distally located from the base. The curved hollow tube includes a plurality of ridges positioned along a length of the curved hollow tube. Each of the plurality of ridges extends along a perimeter of the curved hollow tube.

Certain embodiments of the disclosure may provide one or more technical advantages. For example, as illustrated, the hair accessory may include a hollow tube that may be curved and that may include a plurality of ridges positioned along the length of the hollow tube. In particular embodiments, by being curved, the hollow tube may have a shape that is more consistent with a natural pony tail, for example. As such, the hollow tube may be capable of providing the person with a thicker pony tail, but the pony tail may still look natural. Furthermore, in particular embodiments, the curved shape of the hollow tube may more easily hide the hair accessory inside of the person's hair, which may prevent the hair accessory from being visible to other people. Additionally, the curved hollow tube may further include a plurality of ridges positioned along the length of the curved hollow tube. In particular embodiments, the ridges may allow a hair band to securely bind (or otherwise couple) the person's hair to the curved hollow tube, thereby providing the person with a thicker pony tail that may still look natural and that may remain in place, for example.

As another example, the hollow tube may further include a top exterior surface that is coupled to the base at an angle of 60 degrees, or approximately 60 degrees. In particular embodiments, such an angle may further allow the person's pony tail to have a more natural volumized appearance. As a further example, the hollow tube may further be made of two different materials. In particular embodiments, the material difference along the length of the hollow tube may allow the hollow tube to be more flexible. As such, the hollow tube may more easily bend, which may allow the person wearing the hair accessory to more comfortably lie down, sit against a chair that presses against the hair accessory, or otherwise put pressure on the hollow tube. As another example, the base of the hair accessory may also be curved. In particular embodiments, the curved base may more accurately fit against the shape of a person's head, thereby causing the hair accessory to be more comfortable to wear by the person, for example.

Certain embodiments of the disclosure may include none, some, or all of the above technical advantages. One or more other technical advantages may be readily apparent to one skilled in the art from the figures, descriptions, and claims included herein.

BRIEF DESCRIPTION OF THE FIGURES

For a more complete understanding of the present disclosure and its features and advantages, reference is now made to the following description, taken in conjunction with the accompanying drawings, in which.

DETAILED DESCRIPTION

Embodiments of the present disclosure are best understood by referring to FIGS. 1-5 of the drawings, like numerals being used for like and corresponding parts of the various drawings.

Figure 1A:
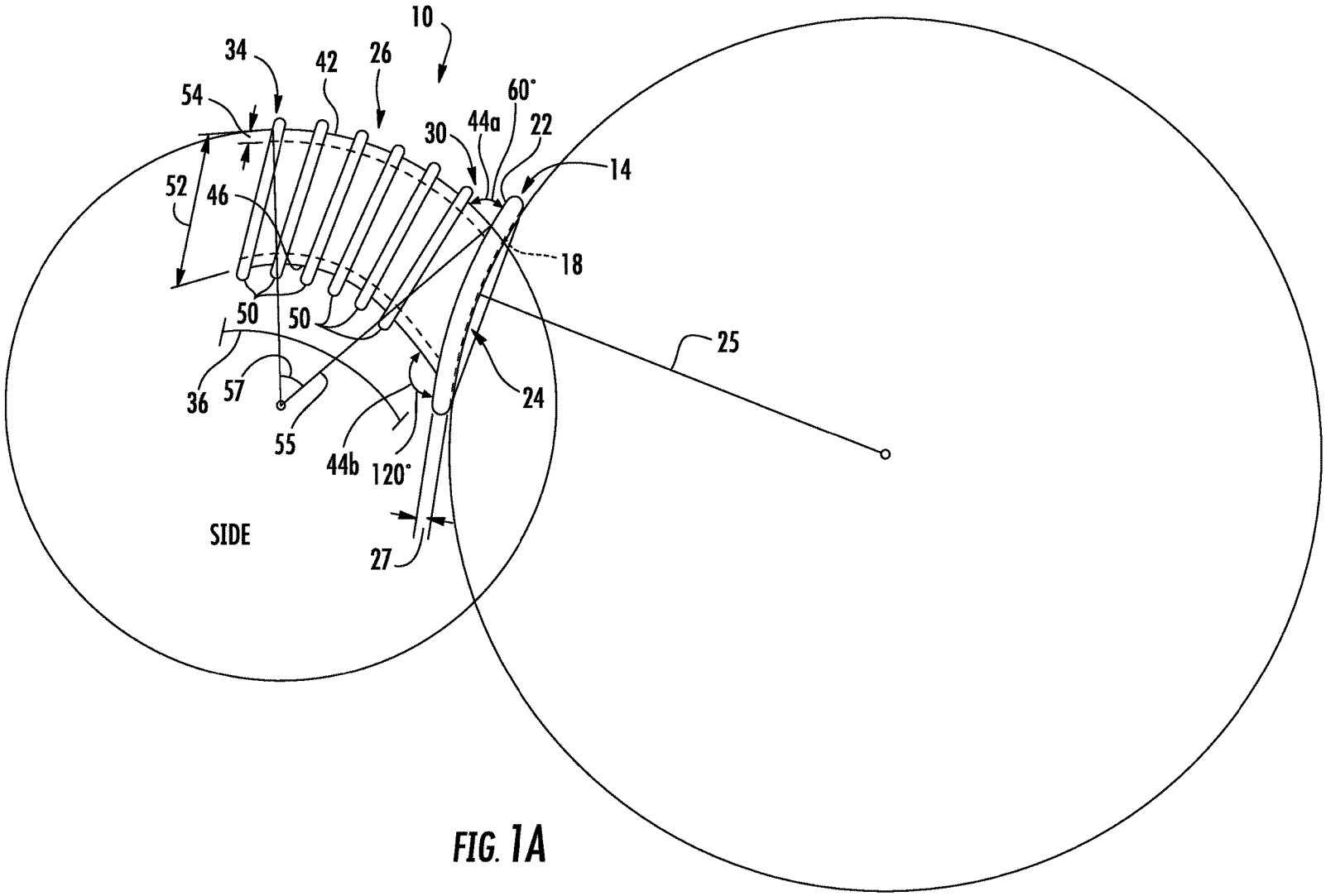
FIGS. 1*a*-1*c* illustrate an example hair accessory.
Figure 1B:
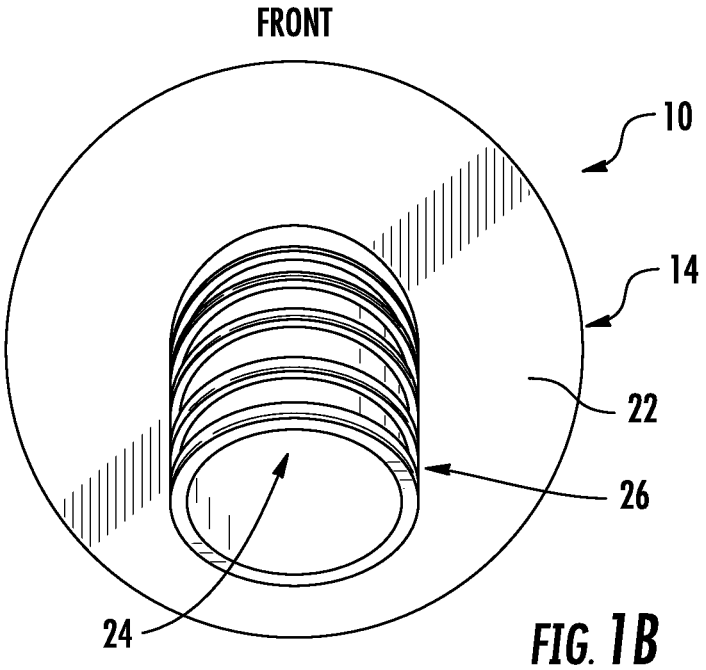
Figure 1C:
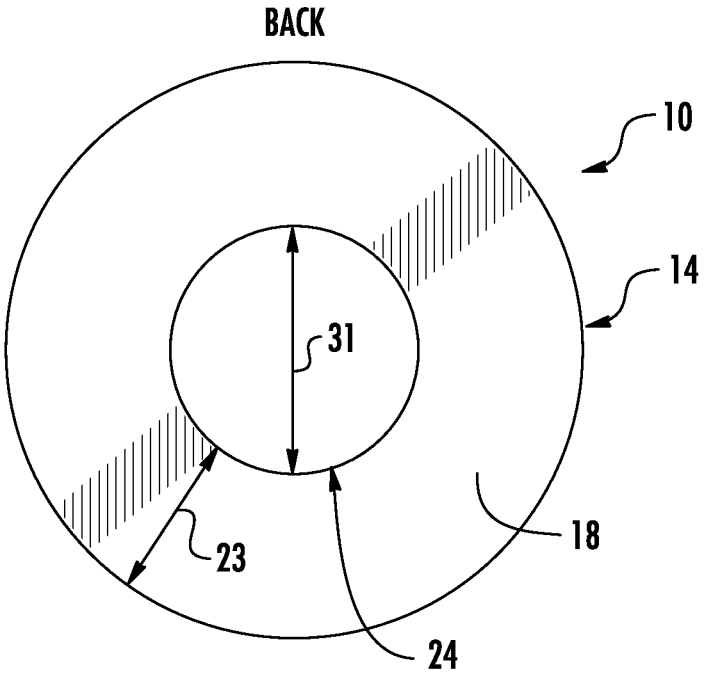

FIGS. 1*a*-1*c* illustrate an example hair accessory. As illustrated, the hair accessory 10 includes a base 14 and a hollow tube 26 coupled to the base 14. The hollow tube 26 may be configured to provide structural support to a portion of a person's hair. For example, the hollow tube 26 may be configured to provide structural support to a person's pony tail. The hollow tube 26 may be curved, and may include a plurality of ridges 50 positioned along the length 36 of the hollow tube 26. In particular embodiments, the hair accessory 10 may be used by a person to create a particular hair style (such as a pony tail). For example, a portion of the person's hair may be lifted up, the base 14 of the hair accessory 10 may be positioned against the head of the person, the person's hair may be gathered around the hollow tube 26 of the hair accessory 10, a hair band may be positioned around the gathered hair and the hollow tube 26 (coupling the gathered hair to the hollow tube 26), and the hair may then be released—creating a pony tail, for example, for the person.

Traditionally, a person (such as a woman, or any other person) may have created a pony tail with her hair by gathering the hair at a location near the scalp, and securing the gathered hair with a hair band. Furthermore, the person may also (or alternatively) have used various traditional devices to help create a different style of a pony tail (or to create a more secure pony tail). Such traditional methods (and/or devices) for creating a pony tail, however, may be deficient. Contrary to such typical deficiencies, the hair accessory 10 may provide one or more advantages. For example, as illustrated, the hair accessory 10 may include a hollow tube 26 that may be curved and that may include a plurality of ridges 50 positioned along the length 36 of the hollow tube 26. In particular embodiments, by being curved, the hollow tube 26 may have a shape that is more consistent with a natural pony tail, for example. As such, the hollow tube 26 may be capable of providing the person with a thicker pony tail, but the pony tail may still look natural.

Furthermore, in particular embodiments, the curved shape of the hollow tube 26 may more easily hide the hair accessory 10 inside of the person's hair, which may prevent the hair accessory 10 from being visible to other people. Additionally, the curved hollow tube 26 may further include a plurality of ridges 50 positioned along the length 36 of the curved hollow tube 26. In particular embodiments, the ridges 50 may allow a hair band to securely bind (or otherwise couple) the person's hair to the curved hollow tube 26, thereby providing the person with a thicker pony tail that may still look natural and that may remain in place, for example.

As another example, the hollow tube 26 may further include a top exterior surface 42 that is coupled to the base 14 at an angle (such as angle 44*a*) of 60 degrees, or approximately 60 degrees. In particular embodiments, such an angle may further allow the person's pony tail to have a more natural volumized appearance. The hollow tube 26 may further be made of two different materials. In particular embodiments, the material difference along the length 36 of the hollow tube 26 may allow the hollow tube 26 to be more flexible. As such, the hollow tube 26 may more easily bend, which may allow the person wearing the hair accessory 10 to more comfortably lie down, sit against a chair that presses against the hair accessory 10, or otherwise put pressure on the hollow tube 26. The base 14 of the hair accessory 10 may also be curved. In particular embodiments, the curved base 14 may more accurately fit against the shape of a person's head, thereby causing the hair accessory 10 to be more comfortable to wear by the person, for example.

Figure 2:
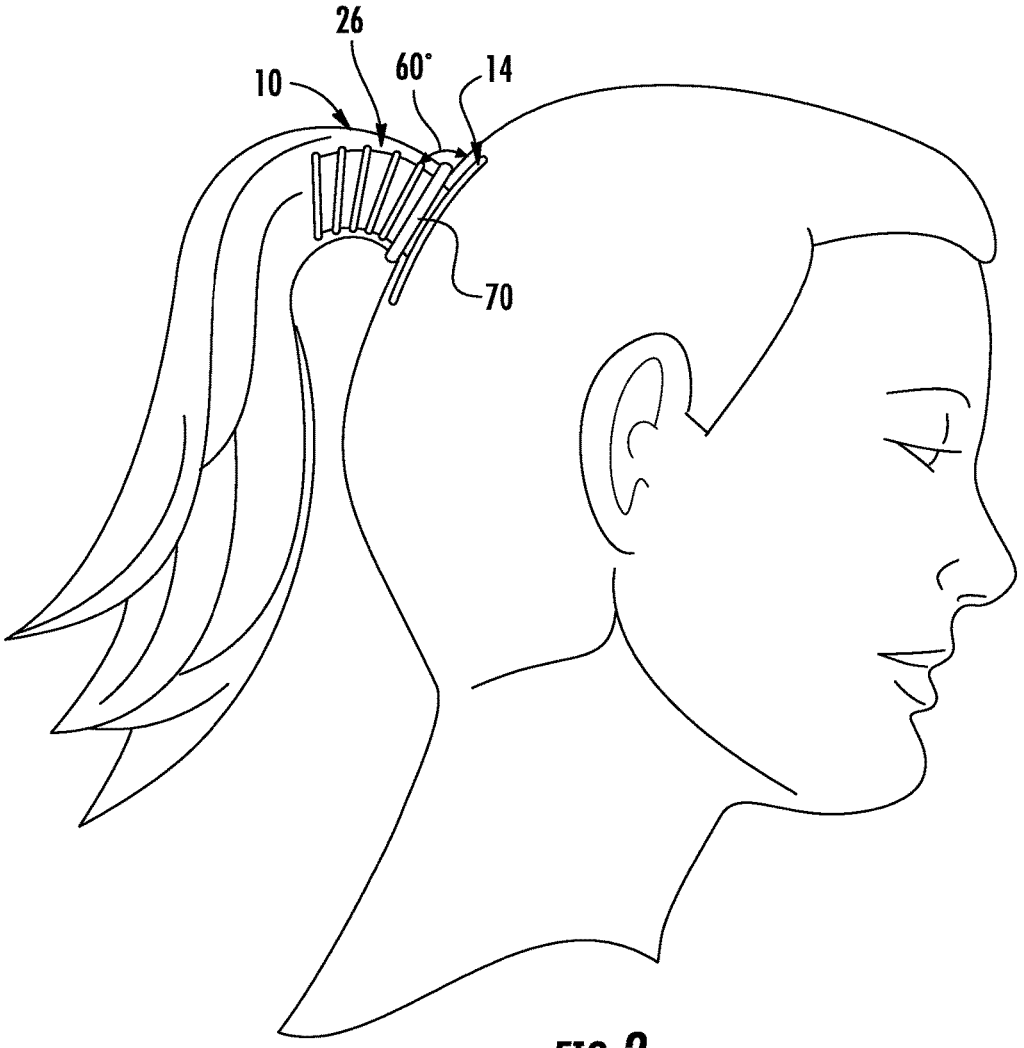
FIG. 2 illustrates an example of the hair accessory of FIG. 1 being used by a person.

As illustrated in FIGS. 1*a*-1*c*, the hair accessory device 10 includes a base 14 and a hollow tube 26 coupled to the base 14. The base 14 may be configured to be positioned against the head of a person using the hair accessory device 10. The person (such as a woman, or any other person) using the hair accessory device 10 may position the base 14 against her head (such as against the back of her head) when the person is using the hair accessory device 10 to create a pony tail with her hair. An example of the base 14 positioned against the head of a person is illustrated in FIG. 2. The base 14 may be positioned against the head of the person in any manner. For example, a portion of the person's hair may be lifted up, and the base 14 may be positioned against the person's head in a location underneath the lifted hair. The base 14 may be positioned directly against the scalp of the person's head, may be positioned against a portion of the person's hair (such as an amount of hair remaining after a portion of the hair has been lifted up), or any combination of the preceding. The base 14 may be positioned at any location on the person's head. For example, the base 14 may be positioned near the top of the person's head (to create a higher pony tail, for example), near the bottom of the person's head (to create a lower pony tail, for example), at a location that is off-center from the center of the person's head (to create a pony tail to the left or right of center of the person's head, for example, or to create multiple pony tails or pig tails on each side of the center of the person's head, for example).

The base 14 may include a back surface 18 and a front surface 22. The back surface 18 may be configured to face towards the head of the person when the base 14 is positioned against the head of the person. Furthermore, the front surface 22 may be configured to face away from the head of the person when the base 14 is positioned against the head of the person.

Figure 4:
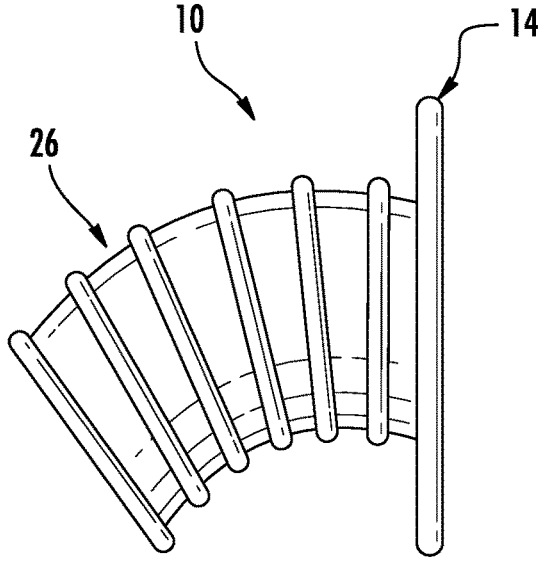
FIG. 4 illustrates a further example of a hair accessory.

The base 14 may have any shape for being positioned against the head of the person. For example, the base 14 may be flat, as is illustrated in FIG. 4. As another example, the base 14 may be curved, as is illustrated in FIG. 1*a*. When the base 14 is curved, the base 14 may have a radius of curvature 25 of for example, 35 mm, or approximately 35 mm (i.e., 35 mm+/−5 mm. Furthermore, when the base 14 is curved, the back surface 18 may be a concave surface that curves inward (e.g., curves inward like the interior of a circle), in particular embodiments. The back surface 18 may curve inward along the entire perimeter of the base (e.g., similar to a bowl, as is seen in FIG. 1*a*), or the back surface 18 may curve inward along only a portion of the perimeter of the base 14 (such as at a top portion of the perimeter of the base 14 and/or a bottom portion of the perimeter of the base 14). Additionally, when the base 14 is curved, the front surface 22 may be a convex surface that curves outward (e.g., curves outward like the exterior of a circle), or the front surface 22 may be a flat surface or any other shaped surface.

In particular embodiments, the curved base 14 may more accurately fit a person's head. For example, the back of a person's head may have a curvature. As such, the curved base 14 may more accurately fit against the curvature of the person's head. In particular embodiments, such a fit may cause the hair accessory 10 to be more comfortable to wear by the person, for example. In contrast to the curved base 14 of the hair accessory 10, traditional devices may have a flat base that may need to be positioned awkwardly against the curvature of the person's head, causing the traditional device to be uncomfortable to wear and to possibly shift back and forth against the curvature of the person's head.

The base 14 may have any perimeter shape. For example, the base 14 may have a circular perimeter shape, an oval perimeter shape, a square perimeter shape, a diamond perimeter shape, an irregular perimeter shape, or any combination of the preceding. The perimeter shape of base 14 may be solid, or it may have one or more gaps (such as gap 24 illustrated in FIGS. 1*a* and 1*c*). The base 14 may have any size (diameter, thickness, etc.). For example, the base 14 may have a base diameter 23 (e.g., the diameter between gap 24 and the perimeter of the base 14) of, for example, 0.5 inches, or approximately 0.5 inches (i.e., 0.5 inches+/−0.2 inches). As another example, the base 14 may have a base thickness 27 of, for example, 2 mm, or approximately 2 mm (i.e., 2 mm+/−1 mm). Furthermore, when the base 14 includes one or more gaps (such as gap 24 illustrated in FIGS. 1*a* and 1*c*), the gap may have a gap diameter 31 of, for example, 19 mm, or approximately 19 mm (i.e., 19 mm+/−5 mm). Also, when the base 14 includes one or more gaps (such as gap 24 illustrated in FIGS. 1*a* and 1*c*), the gap may be positioned in the center of base 14, or may be positioned off-center in the base 14. The base 14 may be formed from any material. For example, the base 14 may be formed from silicone, thermal silicone, a silicone-based material, rubber, plastic, or any combination of the preceding. The base 14 may also be any color. For example, the base 14 may be black, brown, yellow, blonde, gray, charcoal, speckled, clear (or transparent), any other color, or any combination of the preceding.

The hair accessory device 10 further includes a hollow tube 26 coupled to the base 14. The hollow tube 26 may be configured to provide structural support to a person's hair when the hair is gathered around the hollow tube 26. Structural support of a person's hair may refer to any kind of structural support for the person's hair. For example, structural support for the person's hair may refer to the hollow tube 26 providing a shape to the person's hair, such as providing a curving shape for the person's pony tail. As another example, structural support for the person's hair may refer to the hollow tube 26 providing a stem (or other protrusion) around which the person's hair may be gathered, thereby providing a thicker (or fuller) pony tail that surrounds the stem, for example.

The hollow tube 26 may include a first end 30 that that is coupled directly to the base 14, and a second end 34 distally located from the base 14. Additionally, the distance between the first end 30 and the second end 34 may be defined by a length 36 of the hollow tube 26. The hollow tube 26 may further include a top exterior surface 42 and a bottom exterior surface 46. The top exterior surface 42 may be configured to face at least partially in the upward direction (e.g., towards the sky) when the hair accessory 10 is worn by the person. Additionally, the bottom exterior surface 46 may be configured to face at least partially in the downward direction (e.g., towards the ground) when the hair accessory 10 is worn by the person.

The hollow tube 26 may be coupled to the base 14 in any manner. As an example, the hollow tube 26 may be formed integral with the base 14. As another example, the hollow tube 26 may be attached to the base 14 after formation using, for example, an epoxy. Furthermore, the hollow tube 26 may be coupled to the base 14 at any angle. As one example, the top exterior surface 42 of the hollow tube 26 may be coupled to the base 14 at an angle (shown as angle 44*a*) of 60 degrees, or approximately 60 degrees (i.e., 60 degrees+/−10 degrees), and/or the bottom exterior surface 46 of the hollow tube 26 may be coupled to the base 14 at an angle (shown as angle 44*b*) of 120 degrees, or approximately 120 degrees (i.e., 120 degrees+/−10 degrees), as is illustrated in FIG. 1*a*. As a further example, the top exterior surface 42 of the hollow tube 26 may be coupled to the base 14 at an angle (shown as angle 44*a*) of 85 degrees, or approximately 85 degrees (i.e., 85 degrees+/−10 degrees), and/or the bottom exterior surface 46 of the hollow tube 26 may be coupled to the base at an angle (shown as angle 44*b*) of 95 degrees, or approximately 95 degrees (i.e., 95 degrees+/−10 degrees). As another example, the top exterior surface 42 of the hollow tube 26 may be coupled to the base 14 at an angle (shown as angle 44*a*) of 70 degrees, or approximately 70 degrees (i.e., 70 degrees+/−10 degrees), and/or the bottom exterior surface 46 of the hollow tube 26 may be coupled to the base 14 at an angle (shown as angle 44*b*) of 110 degrees, or approximately 110 degrees (i.e., 110 degrees+/−10 degrees). As a further example, the top exterior surface 42 of the hollow tube 26 may be coupled to the base 14 at an angle (shown as angle 44*a*) of 60-85 degrees, and/or the bottom exterior surface 46 of the hollow tube 26 may be coupled to the base 14 at an angle (shown as angle 44*b*) of 95-120 degrees. In such examples, the angle 44*a* (and/or the angle 44*b*) may cause the person's pony tail (created using the hair accessory 10) to have a more natural volumized appearance, in particular embodiments. In contrast to the angle 44*a* of, for example, 60 degrees (or one or more of the other angles 44*a* discussed above) of the hair accessory device 10, traditional devices may have a stem that is coupled to the base at an angle of 120 degrees, causing the person's pony tail to be forced into a non-natural downward droop.

Figure 3:
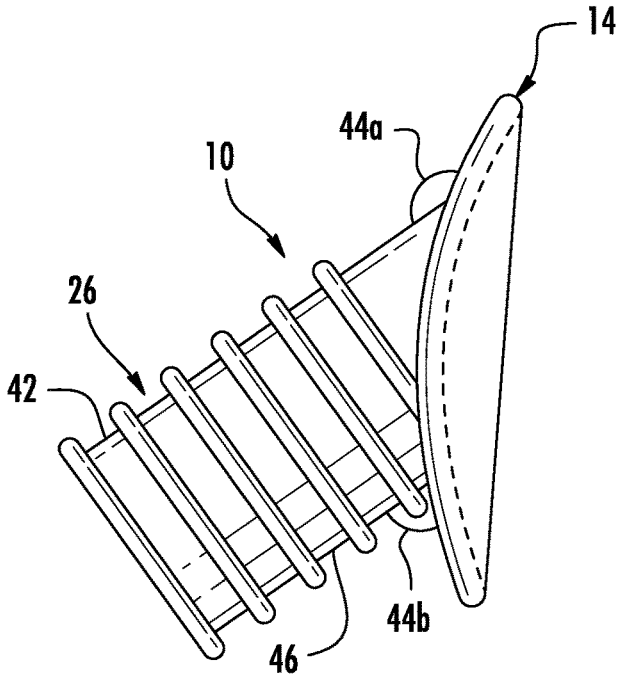
FIG. 3 illustrates another example of a hair accessory.

The hollow tube 26 may have any shape for providing structural support to a person's hair when the hair is gathered around the hollow tube 26. For example, the hollow tube 26 may be straight, as is illustrated in FIG. 3. As another example, the hollow tube 26 may be curved, as is illustrated in FIG. 1*a*. When the hollow tube 26 is curved, the hollow tube 26 may have a radius of curvature 55 of, for example, 40 mm, or approximately 40 mm (i.e., 40 mm+/−4 degrees). Furthermore, when the hollow tube 26 is curved, the curvature of the hollow tube 26 may be defined by an arc 57 of any size. For example, the curvature of the hollow tube 26 may be defined by an arc 57 of 45-90 degrees, 50-90 degrees, 60-90 degrees, 70-90 degrees, 80-90 degrees, 45-85 degrees, 45-80 degrees, 45-70 degrees, 45-60 degrees, or by an arc 57 of any other size. In particular embodiments, by being curved, the hollow tube 26 may have a shape that is more consistent with a natural pony tail, for example. As such, the hollow tube 26 may be capable of providing the person with a thicker pony tail, but the pony tail may still look natural. Furthermore, in particular embodiments, the curved shape of the hollow tube 26 may more easily hide the hair accessory 10 inside of the person's hair, which may prevent the hair accessory 10 from being visible to other people. In contrast to the curved shape of the hollow tube 26 of the hair accessory 10, traditional devices may have a straight stem that is coupled to the base at a large angle, such as 120 degrees. This straight stem of traditional devices may cause the stem to stick out from the person's hair, causing the traditional device to be visible to other people. Additionally, such a straight stem of traditional devices may prevent the pony tail from having a natural look.

In particular embodiments, the curvature of hollow tube 26 may cause the hollow tube 26 to curve at least partially in an upward direction (e.g., toward the sky) along a first portion of the length 36 of the hollow tube 26, as is illustrated in FIGS. 1*a* and 2 by the portion of hollow tube 26 located adjacent first end 30. In particular embodiments, the curvature of the hollow tube 26 may also (or alternatively) cause the hollow tube 26 to curve at least partially in a downward direction (e.g., towards the ground) along a second portion of the length 36 of the hollow tube 26, as is illustrated in FIGS. 1*a* and 2 by the portion of hollow tube 26 located adjacent second end 34. In particular embodiments, such a curvature may allow the hollow tube 26 to provide a person with a more natural looking pony tail, for example.

The hollow tube 26 may include one or more ridges 50. A ridge 50 may be a protrusion from the hollow tube 26, and may be configured to allow a hair band (or other attachment device) to securely bind (or otherwise couple) the person's hair to the hollow tube 26. For example, after the person's hair is gathered around the hollow tube 26, a hair band (or other attachment device) may be positioned around the hair and the hollow tube 26. In particular embodiments, the hair band (or other attachment device) may be positioned around the hollow tube 26 in a location between two successive ridges 50. The two successive ridges 50 may protrude from the hollow tube 26, securing the hair band (or other attachment device) between the gap between the successive ridges 50, thereby preventing the hair band from slipping off (or moving to a different location on) the hollow tube 26. As such, the pony tail made using the hollow tube 26 may remain in place once created, for example.

The hollow tube 26 may include any number of ridges 50. For example, the hollow tube 26 may include one, two, three, four, five, six, seven, eight, ten, fifteen, or any other number of ridges 50. Each ridge 50 may be positioned along the length 36 of the hollow tube 26. In particular embodiments, the hollow tube 26 may include ridges 50 along the entire length 36 of the hollow tube 26 (as is illustrated in FIG. 1*a*), or may include ridges 50 along a portion of the length 36 of the hollow tube 26 (such as ridges 50 positioned only on the portion of the hollow tube 26 that is curving in an upward direction). Also, each ridge 50 may extend along the entire perimeter of the hollow tube 26 (such as the circumference of the circular shaped hollow tube 26 illustrated in FIG. 1*a*). Alternatively, each ridge 50 may extend along only a portion of the perimeter of the hollow tube 26. For example, each ridge 50 may only extend on the top exterior surface 42 of the hollow tube 26 and/or the bottom exterior surface 46 of the hollow tube 26. Furthermore, the ridges 50 may be angled with respect to the hollow tube 26. For example, the ridges 50 may be angled at, for example, 45 degrees, or approximately 45 degrees (i.e., 45 degrees+/−4 degrees), from a center of axis of the hollow tube 26. In other embodiments, the angle of the ridges 50 may remain perpendicular, or approximately perpendicular (i.e., perpendicular+/−4 degrees), to the center of axis of the hollow tube 26. In such an example, when the hollow tube 26 includes a curvature, the ridges 50 may remain approximately perpendicular to the curving center of axis of the hollow tube 26.

The hollow tube 26 may have any perimeter shape. For example, the hollow tube 26 may have a circular perimeter shape, an oval perimeter shape, a square perimeter shape, a diamond perimeter shape, an irregular perimeter shape, or any combination of the preceding. The hollow tube 26 may have any size (diameter, thickness, etc.). For example, the hollow tube 26 may have a tube diameter 52 of, for example, 25 mm, or approximately 25 mm (i.e., 25 mm+/−5 mm). In particular embodiments, such a tube diameter 52 of the hollow tube 26 may provide the person with a thicker pony tail, but the pony tail may not look un-naturally thick. In contrast to the tube diameter 52 of 25 mm of the hair accessory device 10, traditional devices may have a stem with a diameter of 33 mm or greater, causing the person's pony tail to be un-naturally thick. As another example, the hollow tube 26 may have a tube thickness 54 of, for example, 2 mm, or approximately 2 mm (i.e., 2 mm+/−1 mm). As a further example, the hollow tube 26 may have a length 36 of, for example, 35 mm, or approximately 35 mm (i.e., 35 mm+/−10 mm).

The hollow tube 26 may also have a gap 24 that extends from the first end 34 of the hollow tube 26 to the base 14, causing the hollow tube 26 to be hollow. The gap 24 may have any shape. For example, the gap 24 may be circular, oval, square, diamond, an irregular shape, or any combination of the preceding. Additionally, the gap 24 may have any size. For example, the gap 24 may have a gap diameter 31 of for example, 19 mm, or approximately 19 mm (i.e., 19 mm+/−5 mm). Although the gap 24 has been described as extending from the first end 34 of the hollow tube 26 to the base 14, in particular embodiments, the gap 24 may extend over any other portion of the length 36 of the hollow tube 26. Additionally, although the hollow tube 26 has been described as including a single gap 24, the hollow tube 26 may include two or more gaps 24. In such an example, the hollow tube 26 may have interconnecting material between the gaps 24. Furthermore, although hollow tube 26 has been described as having a gap 24, in particular embodiments, the hollow tube 26 may be a solid piece with no gap (e.g., it may not be hollow).

The hollow tube 26 may be formed from any material. For example, the hollow tube 26 may be formed from silicone, thermal silicone, a silicone-based material, rubber, plastic, or any combination of the preceding. In particular embodiments, the hollow tube 26 may be formed from two or more different materials. For example, a first portion of the hollow tube 26 (such as the portion of the hollow tube 26 that curves in an upward direction) may be formed from a first material, such as a first type of silicone, and a second portion of the hollow tube 26 (such as the portion of the hollow tube 26 that curves in a downward direction) may be formed from a second material, such as second type of silicone, that is softer or more flexible than the first material. As another example, a first portion of the hollow tube 26 (such as the portion of the hollow tube 26 that curves in an upward direction) may be formed from a first material, such as rubber, and a second portion of the hollow tube 26 (such as the portion of the hollow tube 26 that curves in a downward direction) may be formed from a second material, such as silicone, that is softer or more flexible than the first material. In particular embodiments, the material difference along the length 36 of the hollow tube 26 may allow the hollow tube 26 to be more flexible near the second end 34, for example, of the hollow tube 26. As such, the second end 34 of the hollow tube 26 may more easily bend (and/or collapse), which may allow the person wearing the hair accessory 10 to more comfortably lie down, sit against a chair that presses against the hair accessory 10, or otherwise put pressure on the hollow tube 26. In contrast, traditional devices may have a stem that is made of the same material, preventing the stem from easily bending. With such traditional devices, if the person were to lie down, sit against a chair that presses against the traditional device, or otherwise put pressure on the traditional device, the action may be uncomfortable to the person and/or may even be painful to the person. In particular embodiments, in addition (or as an alternative) to being made of different materials, the hollow tube 26 may have two different tube thicknesses 54, which may also allow the hollow tube 26 to be more flexible near the second end 34, for example. For example, a first portion of the hollow tube 26 (such as the portion of the hollow tube 26 that curves in an upward direction) may have a tube thickness 54 of, for example, 3 mm, or approximately 3 mm (i.e., 3 mm+/−1 mm), and a second portion of the hollow tube 26 (such as the portion of the hollow tube 26 that curves in a downward direction) may have a tube thickness 54 of, for example, 2 mm, or approximately 2 mm (i.e., 2 mm+/−1 mm).

In particular embodiments, the hollow tube 26 may be formed from the same material as the base 14. For example, the hollow tube 26 may be formed from silicone and the base 14 may be formed from silicone. In other embodiments, the hollow tube 26 may be formed from a different material than the base 14. For example, the hollow tube 26 may be formed from a first material, such as silicone, and the base 14 may be formed from a second material, such as rubber, that is less flexible than the first material. In other embodiments, a first portion of the hollow tube 26 (such as the portion of the hollow tube 26 that curves in an upward direction) may be formed from the same material as the base 14, such as rubber, but a second portion of the hollow tube 26 (such as the portion of the hollow tube 26 that curves in a downward direction) may be formed from a different and more flexible material, such as silicone.

The hollow tube 26 may also be any color. For example, the hollow tube 26 may be black, brown, yellow, blonde, gray, charcoal, speckled, clear (or transparent), any other color, or any combination of the preceding. Furthermore, the hollow tube 26 may be the same color as the base 14, or may be a different color than the base 14. In particular embodiments, the color of both the hollow tube 26 and the base 14 may be selected to match the color of a person's hair. For example, if the person's hair is black, the color of both the hollow tube 26 and the base 14 may be black. As such, the hair accessory 10 may be less visible to other people.

FIG. 2 illustrates an example of the hair accessory of FIG. 1 being used by a person. As illustrated, the hair accessory 10 may be used to create a pony tail on a person. The person may be any person, such as a male, a female, an adult, a child, a teenager, or any other person. In order to use the hair accessory 10, a portion of the person's hair may be lifted up, exposing a portion of the person's head. The base 14 of the hair accessory 10 may be positioned against the person's head in a location underneath the lifted hair. Following the positioning of the hair accessory, the lifted hair may be gathered around the hollow tube 26 of the hair accessory 10. In particular embodiments, the lifted hair may be gathered around the hollow tube 26 in manner that surrounds the perimeter of the hollow tube 10. As such, the hollow tube 26 may provide structural support to the gathered hair by, for example, providing a stem that the hair may be secured to, and which may create a thicker (or fuller) pony tail.

After the hair has been gathered around the hollow tube 26, a hair band 70 may be coupled to the gathered hair and the hollow tube 26. The hair band 70 may be any coupling device that may couple the gathered hair to the hollow tube 26, such as a hair tie, a scrunchie, a hair clip, any other device that may couple the gathered hair to the hollow tube 26, or any combination of the preceding. In particular embodiments, the hair band 70 may tightly wrap around the gathered hair and the hollow tube 26, coupling the hair to the hollow tube 26. The hair band 70 may be further secured to the hollow tube 26 by the ridges 50 included on the hollow tube 26. As an example, two successive ridges 50 may protrude from the hollow tube 26, securing the hair band 70 between the gap between the successive ridges 50, thereby preventing the hair band from slipping off (or moving to a different location on) the hollow tube 26.

After the hair has been coupled to the hollow tube 26 using the hair band 70, the hair may be released by the person wearing the hair accessory 10 (or the person who is inserting the hair accessory 10 into the hair of the person wearing the hair accessory). Once released, the hollow tube 26 may provide structural support for the hair, as is seen in FIG. 2. In particular embodiments, such structural support for the hair may provide a thicker and more natural pony tail (or other hair style).

FIGS. 3-4 illustrate additional examples of a hair accessory. FIG. 3 illustrates a hair accessory 10 that includes a straight hollow tube 26 (as opposed to a curved hollow tube 26). Furthermore, FIG. 3 also illustrates a hollow tube 26 with a top exterior surface 42 that is coupled to the base 14 at an angle (such as angle 44*a*) of 120 degrees, or approximately 120 degrees (i.e., 120 degrees+/−10 degrees), and/or a bottom exterior surface 46 that is coupled to the base 14 at an angle (such as angle 44*b*) of 60 degrees, or approximately 60 degrees (i.e., 60 degrees+/−10 degrees). FIG. 4 illustrates a hair accessory 10 that includes a flat base 14 (as opposed to a curved base 14).

Modifications, additions, or omissions may be made to the hair accessory 10 without departing from the scope of the invention. For example, although the hollow tube 26 of the hair accessory 10 is described above as including ridges 50, in particular embodiments, the hollow tube 26 may not include any ridges 50. As another example, although the hair accessory 10 has been described above as being used to create a pony tail, in particular embodiments, the hair accessory 10 (or two or more hair accessories 10) may be used to form a portion of the person's hair into any other style. Furthermore, one or more elements (and/or attributes) of the hair accessory 10 of FIGS. 1, 3, and 4 may be combined or omitted.

Figure 5:
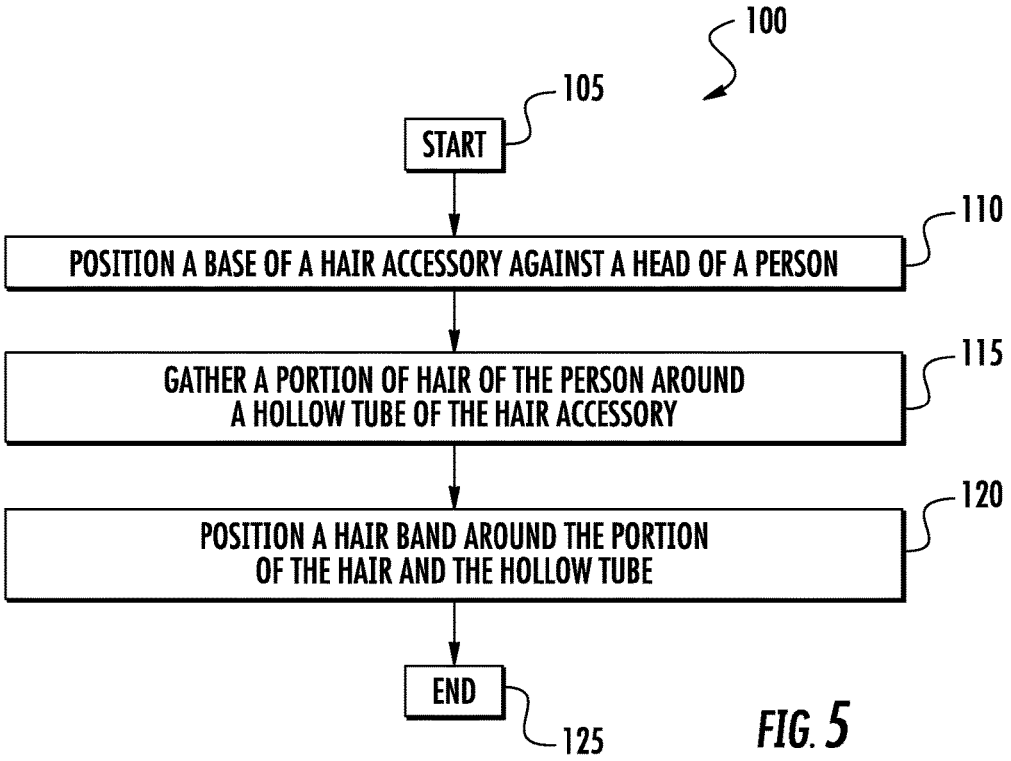
FIG. 5 illustrates an example method of using a hair accessory.

FIG. 5 illustrates an example method of using a hair accessory. One or more of the steps of method 100 may be performed using the hair accessory 10 of FIGS. 1-4. Furthermore, one or more of the steps of method 100 may be performed by the user of the hair accessory 10 of FIGS. 1-4, such as a person wearing the hair accessory 10 of FIGS. 1-4.

The method begins at step 105. At step 110, a base of a hair accessory is positioned against a head of a person. The base may be positioned against the head of the person in any manner. For example, a portion of the person's hair may be lifted up, and the base may be positioned against the person's head in a location underneath the lifted hair. In particular embodiments, a portion of the person's hair (such as half of the hair used to create a pony tail) may be gathered together in the person's first hand (thereby creating half of a pony tail, for example), and the base may be positioned against the person's head (using the person's other hand, for example) in a location underneath the half of the pony tail. The base may be positioned directly against the scalp of the person's head, may be positioned against a portion of the person's hair (such as an amount of hair remaining after a portion of the hair has been lifted up), or any combination of the preceding. The base may be positioned at any location on the person's head. For example, the base may be positioned near the top of the person's head (to create a higher pony tail, for example), near the bottom of the person's head (to create a lower pony tail, for example), at a location that is off-center from the person's head (to create a pony tail to the left or right of center of the person's head, for example, or to create multiple pony tails or pig tails on each side of the center of the person's head, for example). An example of the base positioned against the head of a person is illustrated in FIG. 2. In particular embodiments, the base may be base 14 of the hair accessory 10 of FIGS. 1-4.

At step 115, a portion of hair of the person is gathered around a hollow tube of the hair accessory. The portion of the hair may be any portion of the hair of the person. For example, the portion may be a portion of the hair (such as, for example, all of the hair) that the person wants to style into a pony tail (or any other style). As another example, the portion of the hair may be the portion of the hair that was lifted in order to position the base, or it may be more or less hair than was lifted (such as the portion of the hair that was not lifted). The hair may be gathered around the hollow tube in any manner. As one example, the hair may be gathered around the hollow tube in a manner that surrounds (entirely or partially) the perimeter of the hollow tube of the hair accessory. In particular embodiments, when a person has already created half of a pony tail (as is discussed above), the rest of the person's hair (such as the second half of the hair) to be used to create the pony tail may be gathered below the hollow tube of the hair accessory while the initial half of the hair is gathered (or otherwise remains) above the hollow tube, causing the hair to completely surround the hollow tube (and, in particular embodiments, the base) of the hair accessory. In particular embodiments, by gathering the portion of the hair around the hollow tube, the hollow tube may provide structural support to the gathered hair by, for example, providing a stem that the hair may be secured to, and which may create a thicker (or fuller) pony tail, for example. In particular embodiments, the hollow tube may be hollow tube 26 of the hair accessory 10 of FIGS. 1-4.

At step 120, a hair band is positioned around the portion of the hair and the hollow tube. The hair band may be positioned around the portion of the hair and the hollow tube in any manner. For example, the hair band may be a hair tie that is stretched, pulled over the hair and the hollow tube, and released, thereby positioning the hair tie around the portion of the hair and the hollow tube. In such an example, positioning the hair tie around the portion of the hair and the hollow tube may further include tightening the hair tie, such as by twisting the hair tie, re-pulling the hair tie over the hair and the hollow tube, and then releasing the hair tie. In particular embodiments, positioning the hair band around the portion of the hair and the hollow tube may include positioning the hair band at a location that is adjacent to at least one of the ridges (such as, for example, ridges 50 of FIGS. 1-4) included on the hollow tube, such as a location between two successive ridges included on the hollow tube. The hair band may be hair band 70 of FIG. 2.

The hair may then be released (e.g., released by the person wearing the hair accessory or by the person who is inserting the hair accessory into the hair of the person wearing the hair accessory), causing the hollow tube to provide structural support for the hair, as is seen in FIG. 2. In particular embodiments, the structural support provided by the hollow tube of the hair accessory may provide a thicker and more natural pony tail (or other hair style). The method then ends at step 125.

Modifications, additions, or omissions may be made to method 100. Additionally, the steps of method 100 may be performed in parallel or in any suitable order.

This specification has been written with reference to various non-limiting and non-exhaustive embodiments. However, it will be recognized by persons having ordinary skill in the art that various substitutions, modifications, or combinations of any of the disclosed embodiments (or portions thereof) may be made within the scope of this specification. Thus, it is contemplated and understood that this specification supports additional embodiments not expressly set forth in this specification. Such embodiments may be obtained, for example, by combining, modifying, or reorganizing any of the disclosed steps, components, elements, features, aspects, characteristics, limitations, and the like, of the various non-limiting and non-exhaustive embodiments described in this specification. In this manner, Applicant reserves the right to amend the claims during prosecution to add features as variously described in this specification, and such amendments comply with the requirements of 35 U.S.C. § § 112(a) and 132(a).

What is claimed is:

1. A hair accessory, comprising:

a curved base configured to be positioned against a head of a person, the curved base having a concave back surface configured to face the head of the person, the curved based further having a convex front surface configured to face away from the head of the person;

a curved hollow tube coupled to the base, the curved hollow tube configured to provide structural support to a portion of hair of the person gathered around the curved hollow tube, the curved hollow tube having a first end that is coupled directly to the curved base and a second end distally located from the curved base, wherein the first end of the curved hollow tube includes a top exterior surface that is coupled to the curved base at an angle of approximately 60 degrees, wherein the curved hollow tube curves at least partially in an upward direction along a first portion of a length of the curved hollow tube and further curves at least partially in a downward direction along a second portion of the length of the curved hollow tube, wherein the curvature of the curved hollow tube is defined by an arc of 45-90 degrees, wherein the curved hollow tube extends along a central longitudinal axis that is curved; and wherein the curved hollow tube includes a plurality of raised ridges positioned along the length of the curved hollow tube, wherein each of the plurality of raised ridges extends uninterrupted along an entire perimeter of the curved hollow tube.

2. The hair accessory of claim 1, wherein the first end of the curved hollow tube includes a bottom exterior surface that is coupled to the curved base at an angle of approximately 120 degrees.

3. The hair accessory of claim 1, wherein the curved hollow tube has a thickness of approximately 2 mm.

4. The hair accessory of claim 1, wherein the curved hollow tube has a diameter of approximately 25 mm.

5. The hair accessory of claim 1, wherein the curved hollow tube is formed from silicone and the curved based is formed from silicone.

6. The hair accessory of claim 1, wherein a first portion of the curved hollow tube is formed from a first material, and wherein a second portion of the curved hollow tube and the curved base are formed from a second material different from the first material.

7. The hair accessory of claim 1, wherein a first portion of the curved hollow tube is formed from silicone, and wherein a second portion of the curved hollow tube and the curved base are formed from rubber.

8. A hair accessory, comprising:

a base configured to be positioned against a head of a person;

a curved hollow tube coupled to the base, the curved hollow tube configured to provide structural support to a portion of hair of the person gathered around the curved hollow tube, the curved hollow tube having a first end that is coupled directly to the base and a second end distally located from the base, wherein the curved hollow tube extends along a central longitudinal axis that is curved; and wherein the curved hollow tube includes a plurality of raised ridges positioned along a length of the curved hollow tube, wherein each of the plurality of raised ridges extends uninterrupted along an entire perimeter of the curved hollow tube.

9. The hair accessory of claim 8, wherein the base is curved.

10. The hair accessory of claim 8, wherein the base is flat.

11. The hair accessory of claim 8, wherein the curvature of the curved hollow tube is defined by an arc of 45-90 degrees.

12. The hair accessory of claim 8, wherein the first end of the curved hollow tube includes a top exterior surface that is coupled to the base at an angle of approximately 60 degrees.

13. The hair accessory of claim 8, wherein the first end of the curved hollow tube includes a bottom exterior surface that is coupled to the base at an angle of approximately 120 degrees.

14. The hair accessory of claim 8, wherein the curved hollow tube has a diameter of approximately 25 mm.

15. The hair accessory of claim 8, wherein a first portion of the curved hollow tube is formed from a first material, and wherein a second portion of the curved hollow tube and the base are formed from a second material different from the first material.

16. A method, comprising:

positioning a base of a hair accessory against a head of a person;

gathering a portion of hair of the person around a curved hollow tube of the hair accessory, the curved hollow tube being coupled to the base, wherein the curved hollow tube includes a plurality of raised ridges positioned along a length of the curved hollow tube, wherein each of the plurality of raised ridges extends uninterrupted along an entire perimeter of the curved hollow tube, wherein the curved hollow tube extends along a central longitudinal axis that is curved; and positioning a hair band around the portion of the hair and the curved hollow tube, the hair band being positioned around the curved hollow tube at a location adjacent at least one of the plurality of ridges.

17. The method of claim 16, wherein the curvature of the curved hollow tube is defined by an arc of 45-90 degrees.

* * * * *